United States Patent [19]

Waters et al.

[11] 4,344,505

[45] Aug. 17, 1982

[54] INSULATION CAP FOR DISAPPEARING STAIRWELLS

[76] Inventors: E. Eugene Waters, 107 E. Westwood Dr.; Gordon E. Harrell, Rte. 6, Box 130, both of Goldsboro, N.C. 27530

[21] Appl. No.: 177,990

[22] Filed: Aug. 14, 1980

[51] Int. Cl.[3] ..... E06C 9/06

[52] U.S. Cl. ..... 182/47; 182/77

[58] Field of Search ..... 182/46, 47, 81, 77

[56] References Cited

U.S. PATENT DOCUMENTS 2,321,499 6/1943 Marschke ..... 182/81

4,151,894 5/1979 Edwards ..... 182/46

4,281,743 8/1981 Fuller ..... 182/78

*Primary Examiner*—Reinaldo P. Machado

*Attorney, Agent, or Firm*—Charles R. Rhodes; Judith G. Smith

[57] ABSTRACT

A rigid block of insulative material, such as expanded polystyrene or having an R value of 19 is mounted above the opening in the ceiling in which a disappearing staircase is mounted. The block is so mounted as to be movable entirely or so that a portion thereof is movable between a first normally closed position to a second open position providing access through the ceiling opening.

5 Claims, 3 Drawing Figures

INSULATION CAP FOR DISAPPEARING STAIRWELLS

BACKGROUND & SUMMARY OF THE INVENTION

In recent years there has been considerable activity and emphasis on home insulation. Much money, time, and effort is now being spent by homeowners having various areas insulated. One of the primary areas to be insulated is the attic floor. In this area, homeowners are laying strips or batts of insulation or loose fill insulation up to fourteen inches thick in an effort to retain heat in the area below in the winter time and to keep the heat out of the area below in the summer time. The attic temperature normally approximates the outside temperature in the wintertime, and is much higher than the outside temperature in summer because of the absorption of heat by the roof. Therefore this is the basis of the emphasis on insulating these areas.

One area conventionally overlooked has been the disappearing staircase. In homes where a disappearing staircase provides access through the ceiling into the attic, the area immediately above the staircase has not been adequately insulated, because access is necessary through the ceiling opening when the staircase is pulled down to the opened position. As a factual matter, to leave this area unattended is a serious mistake if the remainder of the attic floor is insulated. If this area is left uninsulated, it acts as a chimmey for the heat in the wintertime, and heat is actually drawn through this rectangular opening which is approximately three by five feet. As much as 20% of the heat loss which would occur if the attic floor were not insulated at all can occur if this area is left unattended. The present invention then is directed toward providing insulation on the attic floor which covers the disappearing staircase. To achieve this result, it is necessary to provide an insulating cap or cover over the opening in the ceiling, which insulation has an R value of at least 19. In addition, it is necessary that this insulation be formed of rigid material and that means be provided for moving the block of rigid material from a first normally closed position covering the opening in the ceiling to a second open position providing access therethrough for a person wanting to ascend the staircase into the attic area.

The cap is formed by either molding or fabricating a rigid body of insulative material having such thickness as to realize an R value of at least 19. The block is formed with dimensions as to adequately cover the area in the ceiling in which the staircase is received. In addition, the underside of the block includes a hollowed out portion in which the staircase is received in the folded position. In such folded position the staircase actually fits into the opening in the ceiling and extends above the floor level of the attic. The aforementioned hollowed out portion or recess receives the folded staircase therein.

Additionally, there is provided a mounting means for permitting the body easy, controlled movement of rigid insulating material, or at least a portion thereof to a position removed from the opening in the ceiling when entrance to the attic is desired. This is accomplished preferably by hinging the cover of the block to the side walls or by hinging the block along one edge thereof, so that a person standing on the staircase merely pushes the cover or the entire block itself up around the hinged edge, thereby providing an entranceway to the attic.

Additionally, the insulative body might be mounted in a longitudinal pair of tracks and slid longitudinally of the opening to uncover it. Other approaches for moving the block from a first normally closed position to an open position are also possible.

It is therefore an object of the present invention to provide an insulation cap for disappearing stairwells.

It is another object of the present invention to insulate the area above disappearing staircases to prevent loss of heat therethrough.

Other objects and a fuller understanding of the invention will become apparent from reading the following detailed description of a preferred embodiment along with the accompanying drawings in which.

DETAILED DESCRIPTION OF A PREFERRED EMBODIMENT

Figure 1:
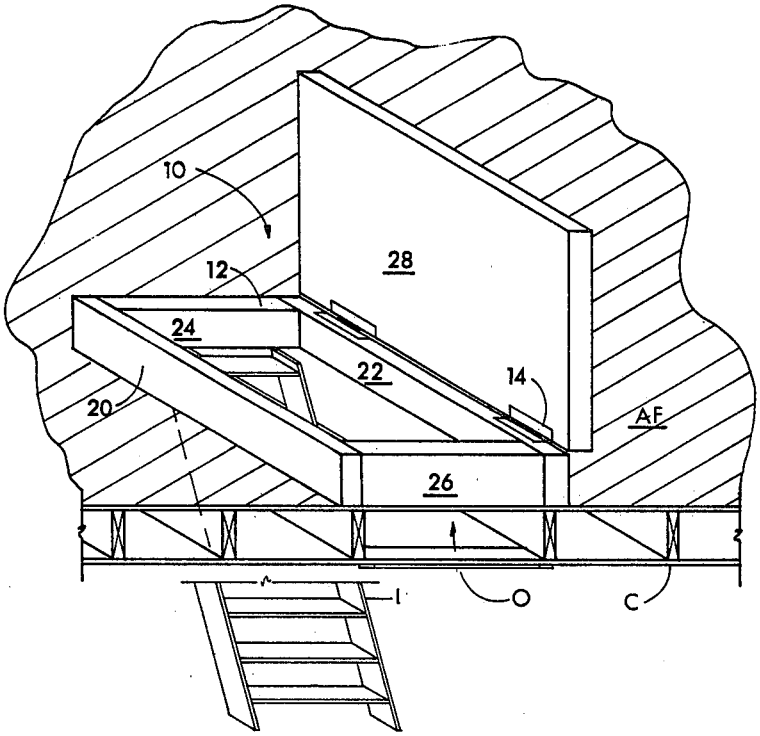
FIG. 1 is a perspective view illustrating a portion of an attic floor having an insulated cap for disappearing staircases according to the present invention with the staircase lowered and the insulated cap raised.

Turning now to the drawings, and particularly to FIG. 1, there is illustrated an attic floor AF having a disappearing staircase D mounted in a suitable opening in the ceiling of the room below and the attic floor in accordance with conventional practices. It should be noted here that conventional disappearing staircases are mounted within a ceiling opening approximately twenty-five and one-half inches wide by sixty inches long. The size of the opening however is immaterial as blocks of insulation can be formed with varying dimensions for openings of various sizes.

Figure 2:
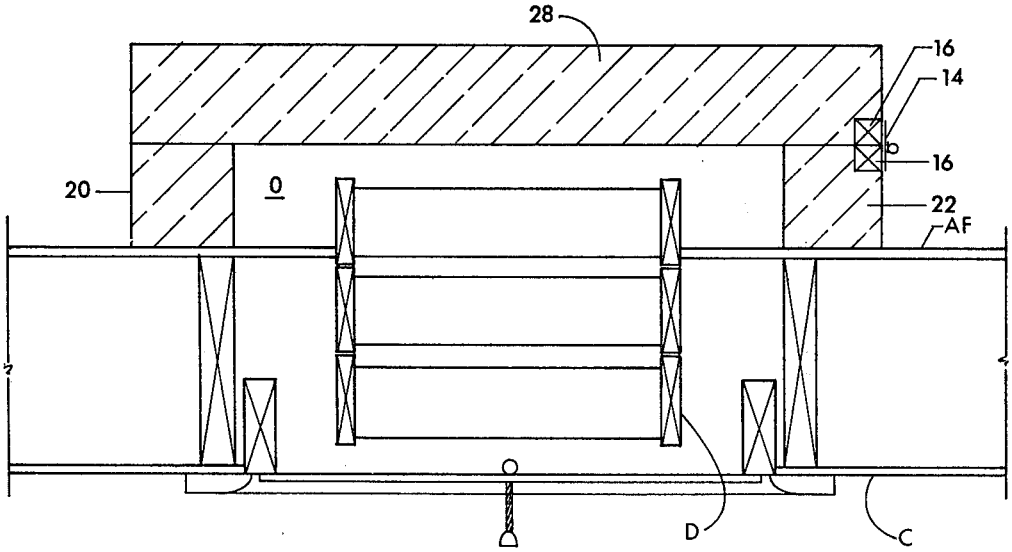
FIG. 2 is a sectional view illustrating the staircase closed and the insulated cap in position.

In accordance with the present invention there is provided a rigid body 10 of insulative material, preferably expanded polystyrene beads, expanded polyurethane beads, or other expanded polymeric beads or foam. The block 10 has such outer dimensions as to completely cover the ceiling opening O. In this regard, for a ceiling opening of twenty-five and one-half inches by sixty inches, the dimensions of block 10 are approximately thirty-four inches by sixty-six inches; however, these other dimensions are not critical as long as the opening O is sufficiently covered. In the underneath side of the block 10, a clearance recess 12 is provided for receiving the staircase portion of the disappearing stairwell D when in the folded position as illustrated in FIG. 2. In conventional installations when the staircase is folded, it extends upwardly slightly above the attic floor AF. A hinge means 14 such as a piano hinge or a plastic hinge supports one side or end of the cap 10 to the attic floor AF or, preferably, a portion (cover 28) of the cap to the side or end walls of the caps. A strip of wood or furring is embedded in the adjacent edge of the side wall of the cap 10 to provide a holding surface onto which the hinge may be attached, as the styrofoam or other expanded polymeric foam does not adequately hold screws or other fasteners.

Figure 3:
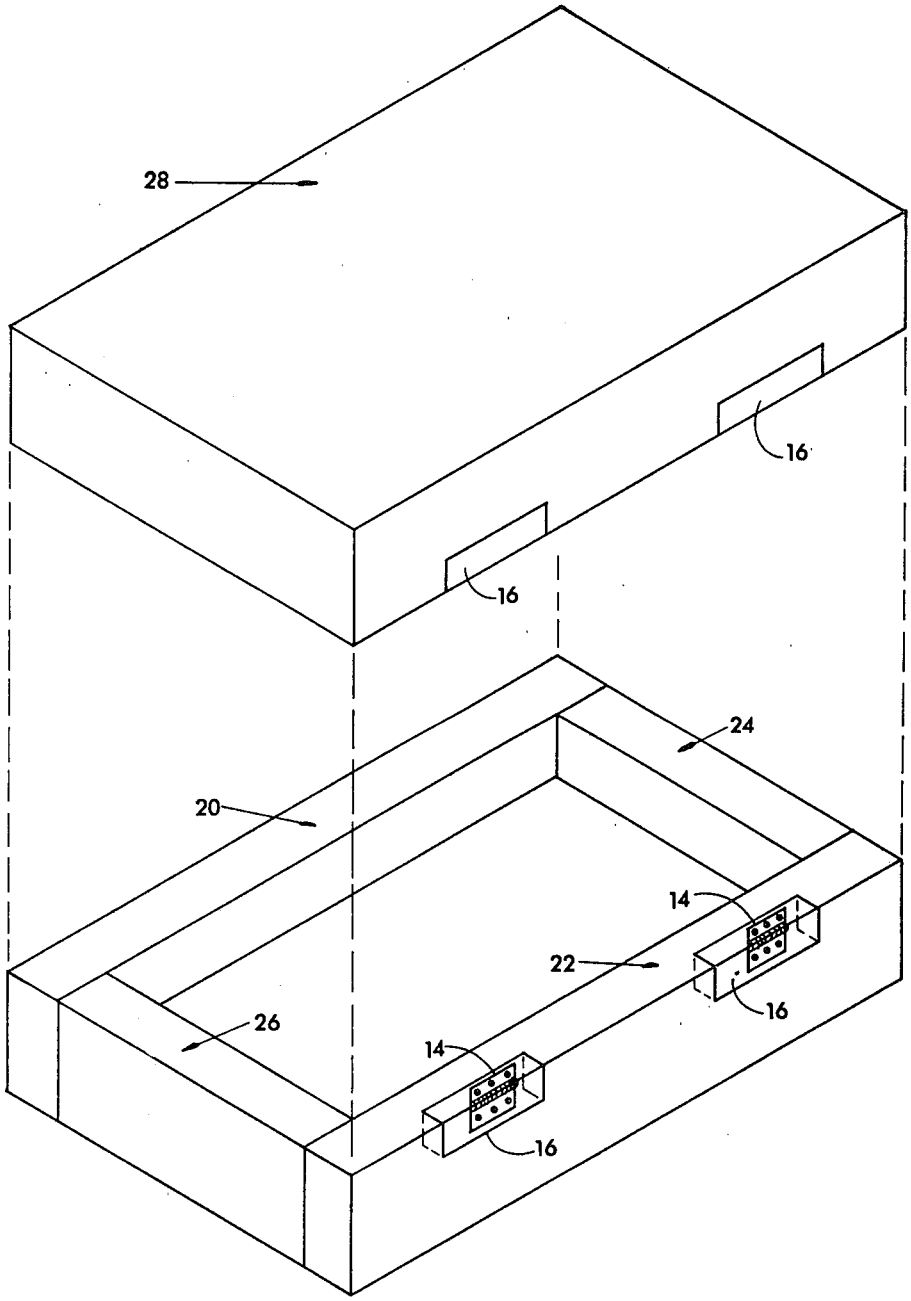
FIG. 3 is an exploded view illustrating a proposed scheme for fabricating the insulative cap of FIG. 1.

Turning now to FIG. 3, there is illustrated one preferred embodiment in which the cap 10 is formed of the selected insulation material in conventional bar stock and sheets. The sides 20,22 and ends 24,26 are secured together in a rectangular pattern. The top or cover 28 is a sheet of the same material having outer dimensions substantially the same as the outer dimensions of the rectangular frame. The sheet 28 is hingedly attached along one edge 29 by a pair of strap hinges 14 to the upper edge of one side wall 22. Alternatively the sheet 28 could be secured to the rectangular frame and the frame hingedly attached to the attic floor AF. It can further be easily seen that the cap 10 could be hinged at the ends rather than the sides without departing from the scope of the invention.

In an alternate embodiment (not shown), rather than providing hinge 14 for attaching the cover 28 to side wall 22 there might be provided a pair of rails along the attic floor and flanges extending outwardly from the cap 10 to provide sliding movement of the cap for purposes of moving the cap to the second opened position. It should be here realized that any manner for allowing a person standing on the staircase in the folded down position to move the cap away from its closed position over the opening is within the scope of this invention, and the two techniques described hereinabove are illustrative only. Also the cap might be molded as an integral unit instead of fabricated from sheet and/or bar stock.

While a preferred embodiment of the present invention has been described in detail hereinabove, it is apparent that various changes and modifications might be made without departing from the scope of the invention which is set forth by the accompanying claims.

What is claimed is:

1. An insulating cap for attic openings which receive disappearing staircases of the type in which a casement mounted in the attic opening supports a folddown staircase with the ladder portion of the staircase extending up into the attic area above the opening when said staircase is in the folded position, said cap comprising:

(a) a stationary rectangular frame formed substantially in its entirety of rigid insulative material having length and width dimensions greater than the corresponding dimensions of the opening in the attic floor; said frame including a pair of spaced sidewalls and a pair of spaced end walls secured together to form said rectangular frame, said side walls and said end walls being separate from said folddown staircase and when assembled surround said attic opening to form a recess for receiving, but not supporting said staircase in the folded position;

(b) a cover member formed substantially in its entirety having length and width dimensions greater than said attic floor opening and removably supported by the upper surface of said rectangular frame;

(c) said rigid insulative material from which said frame and cover are formed having an R value of at least 19 through the thickness thereof;

(d) said cover being so positioned with respect to said rectangular frame that said cover is movable between a first normally closed position to a second open position providing access through said opening by a person standing on said staircase while said frame remains stationary.

2. The insulating cap wherein said rigid insulating material is expanded polymeric foam.

3. The insulating cap according to claim 1 wherein said cover is completely separable from said rectangular frame.

4. The insulating cap according to claim 1 wherein said cover is hingedly attached to said frame by a hinge means connecting one side edge of said cover to a corresponding side wall of said frame.

5. The insulating cap according to claim 4 wherein strips of wood furring material are imbedded into the portion of said cover and said side wall of said frame underneath said hinge means for securing said hinge means thereto.

* * * * *